US006366269B1

(12) United States Patent
Watkins et al.

(10) Patent No.: US 6,366,269 B1
(45) Date of Patent: Apr. 2, 2002

(54) METHOD AND APPARATUS FOR SPACING APART PANELS IN FLAT PANEL DISPLAYS

(75) Inventors: Charles M. Watkins, Meridian; Jason B. Elledge, Boise, both of ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/507,561

(22) Filed: Feb. 18, 2000

Related U.S. Application Data

(62) Division of application No. 09/001,485, filed on Dec. 31, 1997.

(51) Int. Cl.[7] ..... G09G 3/36
(52) U.S. Cl. ..... 345/87; 345/204; 313/482
(58) Field of Search ..... 345/87, 204, 158, 345/163, 167, 168; 313/482, 495, 496

(56) References Cited

U.S. PATENT DOCUMENTS 5,063,327 A 11/1991 Brodie et al.
5,153,483 A 10/1992 Kishinio et al.
5,186,670 A 2/1993 Doan et al.
5,543,683 A * 8/1996 Haven et al. ..... 313/461
5,561,343 A * 10/1996 Lowe ..... 313/482
5,708,325 A 1/1998 Anderson et al.
5,774,103 A * 6/1998 Choi et al. ..... 345/94
5,804,917 A * 9/1998 Takahashi et al. ..... 313/504
6,023,262 A * 2/2000 Eglit ..... 345/131
6,064,303 A * 5/2000 Klein et al. ..... 340/506
6,072,448 A * 6/2000 Kojima et al. ..... 345/63
6,161,933 A * 12/2000 Tschida et al. ..... 352/179

* cited by examiner

*Primary Examiner*—Richard Hjerpe
*Assistant Examiner*—Kimnhung Nguyen
(74) *Attorney, Agent, or Firm*—Dorsey & Whitney LLP

(57) ABSTRACT

An inventive spacing structure is a unitary structure of uniform height including a multitude of rail members framed by and interconnected with a multitude of frame members. The frame and rail members project between a flat panel display's face and base panels across a substantial area of their facing surfaces. As a result, the unitary spacing structure spaces a substantial portion of the face panel away from the base panel in a substantially parallel spaced apart relationship with the base panel. Because the inventive spacing structure is a unitary structure, it can be conveniently manufactured apart from the flat panel display and then easily aligned with the image generating apparatus of the display. Thus, the unitary spacing structure can help to make flat panel displays less difficult, time-consuming and costly to manufacture. Also, the rail members and frame members of the unitary spacing structure make the structure stronger than conventional columnar spacers because the rails distribute the force they support. As a result, the unitary spacing structure can easily exceed 100 $\mu$m in height and can thereby help increase the brightness of flat panel displays which are field emission displays.

21 Claims, 3 Drawing Sheets

METHOD AND APPARATUS FOR SPACING APART PANELS IN FLAT PANEL DISPLAYS

CROSS-REFERENCE TO RELATED APPLICATION

This application is a divisional of pending U.S. patent application Ser. No. 09/001,485, filed Dec. 31, 1997.

This invention was made with government support under Contract No. DABT-63-93-C-0025 awarded by Advanced Research Projects Agency (ARPA). The government has certain rights in this invention.

TECHNICAL FIELD

The present invention relates in general to flat panel displays, and in particular to spacers for spacing apart panels in flat panel displays.

BACKGROUND OF THE INVENTION

A conventional flat panel display 10 shown in FIG. 1 is useful in a portable device, such as a notebook computer 12, that requires a thin display having less weight and power consumption than a cathode ray tube (CRT) display. Typical well-known flat panel displays are field emission displays, passive and active matrix liquid crystal displays, and plasma displays.

As shown in FIG. 2 in a cut-away view, a conventional flat panel display 10 generally includes a transparent face panel 14 spaced apart from a base panel 16. In a field emission display, the face and base panels 14 and 16 are spaced apart from one another to create a space which can be evacuated so electrons will be emitted from emitters (not shown) in the base panel 16. Also, in a liquid crystal display, the face and base panels 14 and 16 are spaced apart to create a space for liquid crystal cells, and in a plasma display the face and base panels 14 and 16 are spaced apart to create a space which can be filled with a gas for generating plasma.

The face panel 14 and base panel 16 are typically spaced apart from one another by thousands of columnar spacers 18 individually formed or positioned between the panels 14 and 16. Because the columnar spacers 18 must be individually formed or positioned, the flat panel display 10 can be difficult, time-consuming and costly to manufacture. Also, the columnar spacers 18 cannot be positioned accurately enough to ensure that they do not interfere with an image generating apparatus (not shown) in the flat panel display 10. As a result, it is sometimes necessary to scrap the flat panel display 10 after manufacturing if its display image 20 is substantially affected by interference from the columnar spacers 18. Further, the columnar spacers 18 are generally limited to about 100 $\mu$m in height because they are unstable above that height. As a result, the brightness of field emission displays is limited, because the limited height of the columnar spacers 18 limits the distance between the face and base panels 14 and 16 which, in turn, limits a voltage differential between the panels 14 and 16. The limited voltage differential limits the brightness of the field emission displays.

Therefore, there is a need in the art for an improved structure for spacing apart the face and base panels in flat panel displays. The structure should be simple to manufacture, easy to align with the image generating apparatus in a flat panel display, and capable of exceeding 100 $\mu$m in height to help increase the brightness of field emission displays.

SUMMARY OF THE INVENTION

An inventive spacing structure is a unitary structure of uniform height which projects between a flat panel display's face and base panels across a substantial area of their facing surfaces. As a result, the unitary spacing structure spaces a substantial portion of the face panel away from the base panel in a substantially parallel spaced apart relationship with the base panel. Preferably, the unitary spacing structure includes a multitude of rail members framed by and interconnected with a multitude of frame members. Because the inventive spacing structure is a unitary structure, it can be conveniently manufactured apart from the flat panel display and then easily aligned with the image generating apparatus of the display. Thus, the unitary spacing structure can help to make flat panel displays less difficult, time-consuming and costly to manufacture. Also, the rail members and frame members of the preferred unitary spacing structure make the structure stronger than conventional columnar spacers because the rails distribute the force they support. As a result, the unitary spacing structure can easily exceed 100 $\mu$m in height and can thereby help increase the brightness of field emission displays.

DETAILED DESCRIPTION OF THE INVENTION

Figure 1:
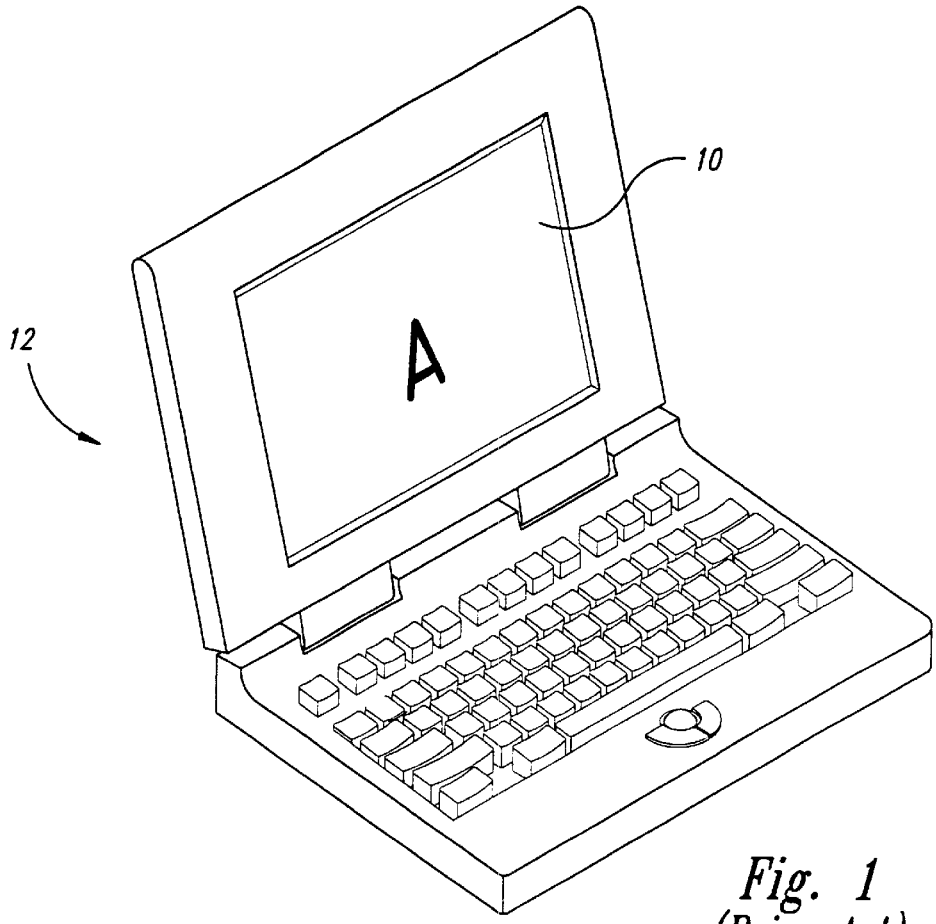
Fig. 1 (Prior Art)
FIG. 1 is an isometric view of a typical notebook computer incorporating a conventional flat panel display.
Figure 2:
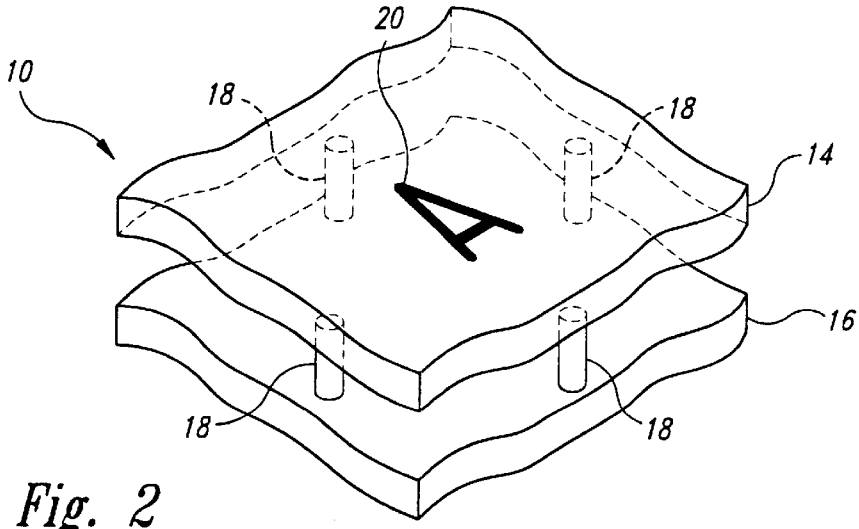
Fig. 2 (Prior Art)
FIG. 2 is an isometric view of a portion of the conventional flat panel display of FIG. 1.
Figure 3:
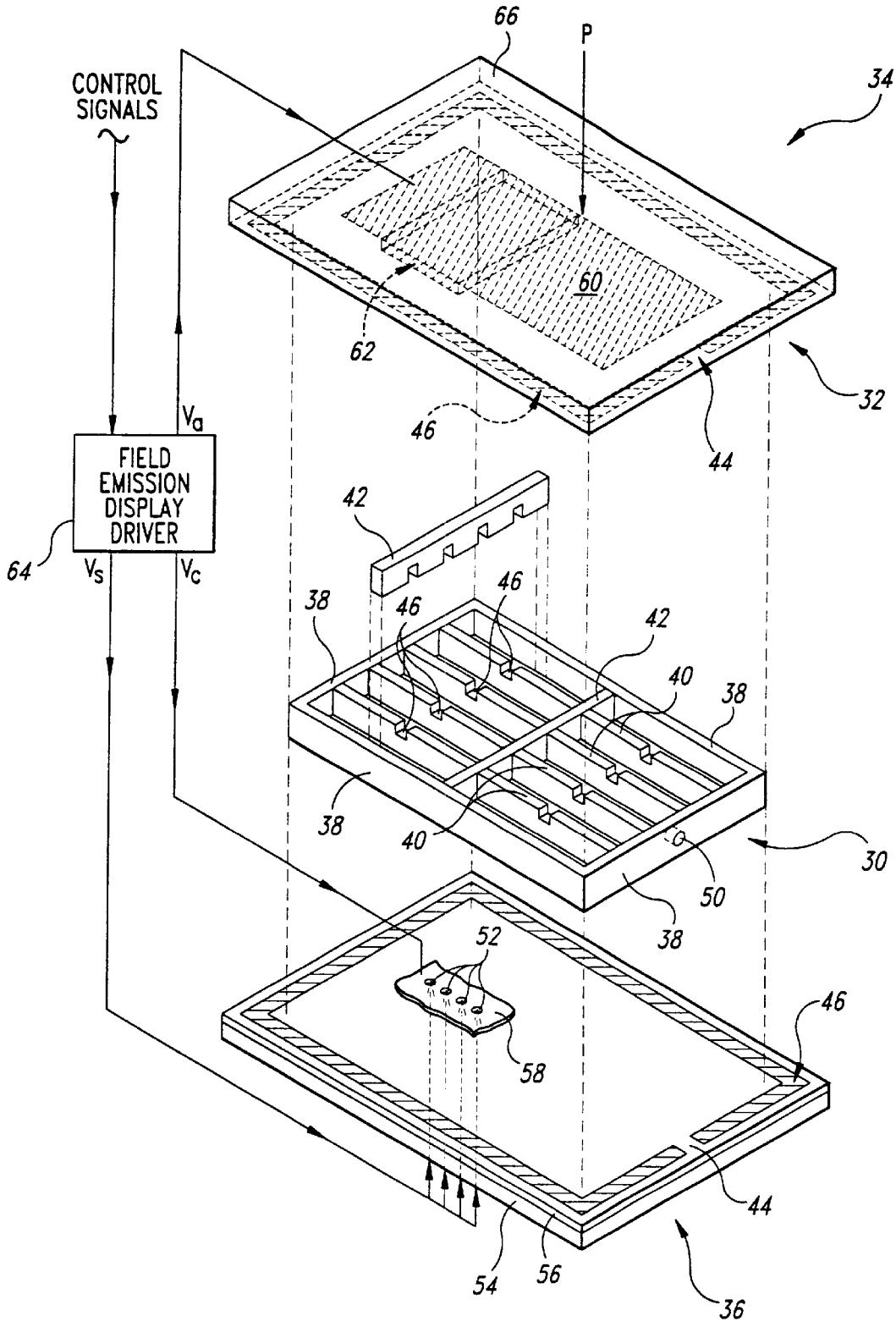
FIG. 3 is an exploded isometric view of a flat panel display including a unitary spacing structure according to the present invention.

An inventive unitary spacing structure 30 of uniform height shown in FIG. 3 spaces a substantially transparent face panel 32 of a field emission display 34 apart from a base panel 36 of the display 34 in a substantially parallel relationship. Although the unitary spacing structure 30 will be described in connection with the field emission display 34, it will be understood that the unitary spacing structure 30 works well with any flat panel display having panels which need to be spaced apart, including passive and active matrix liquid crystal displays and plasma displays.

Because the inventive spacing structure 30 is a unitary structure, it can be conveniently assembled apart from the field emission display 34 and then easily aligned with the image generating structure of the display 34 described below using alignment marks (not shown) on the face and base panels 32 and 36. Of course, the unitary spacing structure 30 can alternatively be assembled on one or both of the face and base panels 32 and 36.

The unitary spacing structure 30 preferably includes a multitude of frame members 38 connected to a multitude of rail members 40 and 42 using an adhesive such as Torr Seal®. Of course, the frame members 38 and rail members 40 and 42 can be connected in a wide variety of other ways, or can be integrally formed with one another. When the field emission display 34 is assembled, the frame members 38 are attached to the face panel 32 and, preferably, the base panel 36 with an adhesive such as Torr Seal®. Also, although a relatively small number of relatively wide frame members 38 and rail members 40 and 42 are shown in FIG. 3 for purposes of description, it will be understood that hundreds or thousands of very narrow frame members 38 and rail members 40 and 42 are typically used in the inventive unitary spacing structure 30. Further, although the rail members 40 and 42 are shown in FIG. 3 positioned at right angles to the frame members 38, each of the rail members 40 and 42 can be positioned at a wide variety of angles with respect to the other rail members 40 and 42 and with respect to the frame members 38.

The frame members 38 can be manufactured with a width exceeding 1,500 $\mu$m and a height exceeding 500 $\mu$m, and the rail members 40 and 42 can be manufactured with a width exceeding 50 $\mu$m and a height exceeding 500 $\mu$m. Thus, the unitary spacing structure 30 can increase the distance between the face panel 32 and the base panel 36 well beyond the conventional 100 $\mu$m, and thereby makes it possible to increase the brightness of the field emission display 34 by increasing the voltage differential between the face panel 32 and the base panel 36 described below.

The frame members 38 and rail members 40 and 42 can be made from a wide variety of materials, including ceramics, some plastics, and glass aerogels. Because the space between the face panel 32 and the base panel 36 is typically evacuated to a pressure of approximately $10^{-6}$ torr in comparison to standard atmospheric pressure of 760 torr, any material used for the frame members 38 and rail members 40 and 42 should be strong enough to withstand a pressure force P, such as 14.7 pounds per square inch, on the surface of the face panel 32. Any material used should also be substantially non-conductive to prevent the voltage differential between the face panel 32 and the base panel 36 (described below) from breaking down, should not de-gas under the electron bombardment present between the face panel 32 and the base panel 36 (described below), and should have little or no creep, i.e., deformation over time.

In order to allow evacuation of the space between the face panel 32 and the base panel 36, an evacuation aperture 44 is preferably left in a glass frit or powdered metal bead 46 during manufacturing. When the field emission display 34 is assembled and the bead 46 is cured, the bead 46 seals the space between the face and base panels 32 and 36. As a result, a vacuum applied at the evacuation aperture 44 causes air in the space between the face panel 32 and the base panel 36 to flow through notches 46 connecting the rail members 40 and the rail members 42, and through notches 48 in the rail members 40, toward an evacuation hole 50 in the frame member 38 and out the evacuation aperture 44. Of course, it will be understood that a wide variety of alternative constructions are possible for the unitary spacing structure 30 which allow the space between the face panel 32 and the base panel 36 to be evacuated. For example, some or all of the frame members 38 and the rail members 40 and 42 can be made with a porous ceramic material which allows air to pass.

In an alternative embodiment, the unitary spacing structure 30 itself acts as the seal for the field emission display 34. In this embodiment, the unitary spacing structure 30 is attached to the face panel 32 and the base panel 36 with a cured glass frit bead or cured powdered metal bead, and the space between the face and base panels 32 and 36 is evacuated directly through the evacuation hole 50.

The image generating structure of the field emission display 34 is constructed in a well known manner. Each of a plurality of electron emitters 52 carried by a supporting substrate 54 of the base panel 36 is disposed within a respective aperture in an insulating layer 56 deposited on the surface of the supporting substrate 54. A conductive layer forming an extraction grid 58 is deposited on the insulating layer 56 peripherally about the respective apertures of the emitters 52. An anode 60, such as an indium tin oxide layer, has a localized portion 62 of a cathodoluminescent layer deposited thereon opposite the emitters 52. The cathodoluminescent layer comprises a phosphorescent material which emits light when bombarded by electrons. Of course, it will be understood that flat panel displays such as passive and active matrix displays and plasma displays have different, but equally well-known, image generating structures.

In operation, a conductive voltage $V_C$ such as 40 volts supplied to the extraction grid 58 from a field emission display driver 64 in response to control signals received from external circuitry (not shown), and a source voltage $V_S$ such as 0 volts supplied to the emitters 52 in response to the control signals, creates an intense electric field around the emitters 52. This electric field causes an electron emission to occur from each of the emitters 52 in accordance with the well-known Fowler-Nordheim equation. An anode voltage $V_A$ such as 1,000 volts supplied to the anode 60 from the field emission display driver 64 in response to the control signals attracts these electron emissions toward the face panel 32. Some of these electron emissions bombard the localized portion 62 of the cathodoluminescent layer and cause the localized portion 62 to emit light and to thereby provide a display on a viewing surface 66 of the face panel 32.

Figure 4:
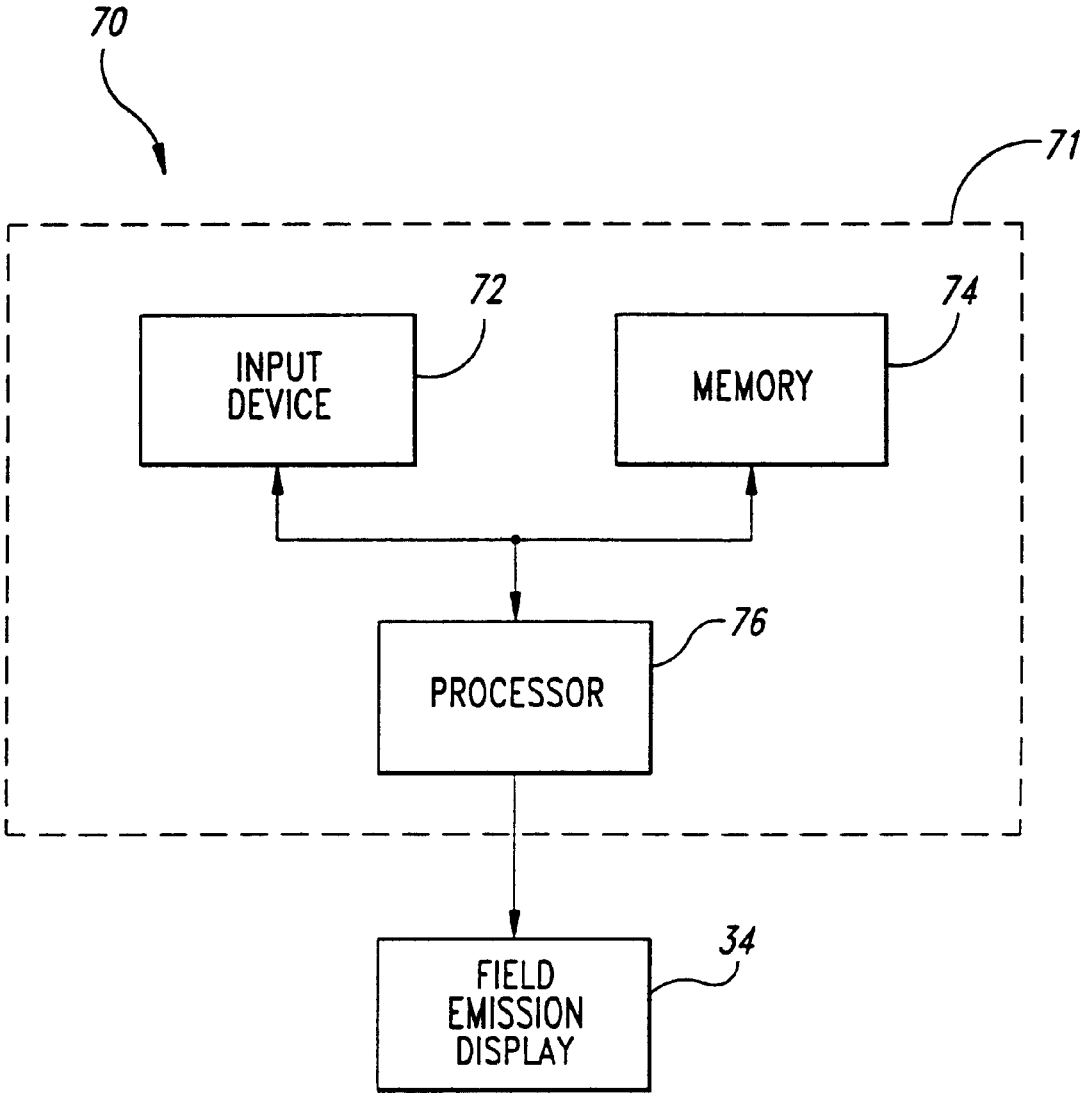
FIG. 4 is a block diagram of an electronic system incorporating the flat panel display of FIG. 3.

As shown in FIG. 4, the field emission display 34 can be incorporated into an electronic system 70 in which it receives appropriate control signals from an electronic modulating device 71. In one embodiment, the electronic modulating device 71 comprises a computer system including an input device 72, such as a keyboard, and memory a 74, both coupled to a processor 76. Of course, it will be understood that the field emission display 34 may be used with any electronic modulating device capable of providing appropriate control signals, including, for example, personal computers, televisions, video cameras and electronic entertainment devices.

Although the present invention has been described with reference to a preferred embodiment, the invention is not limited to this preferred embodiment. Rather, the invention is limited only by the appended claims, which include within their scope all equivalent devices or methods which operated to the principles of the invention as described.

What is claimed is:

1. An electronic system for displaying an image, the electronic system comprising:

an electronic modulating device for generating appropriate control signals to cause a display to display the image; and a flat panel display coupled to the electronic modulating device for displaying the image in response to the control signals received from the electronic modulating device, the flat panel display comprising:

a base panel having a surface with generally planar areas;

a substantially transparent face panel having a surface with generally planar areas facing the surface of the base panel and having an opposing viewing surface for displaying the image thereon;

a unitary spacing structure including a plurality of interconnecting rail members and frame members of uniform height interposed between the face panel and the base panel and projecting therebetween across a substantial area of the facing surfaces of the face and base panels so it spaces a substantial portion of the face panel away from the base panel in a substantially parallel spaced-apart relationship with the base panel, the rail members extending along directions that are substantially parallel with the surfaces of the base and face panels; and an image generator connected to the face and base panels and positioned to emit light through selected pixel locations on the viewing surface of the face panel in response to the control signals in order to display the image on the viewing surface.

2. The electronic system of claim 1 wherein the electronic modulating device comprises a computer system including an input device, a memory, and a processor coupled to the input device and the memory and providing the control signals to the flat panel display.

3. The electronic system of claim 1 wherein the electronic modulating device comprises a television.

4. The electronic system of claim 1 wherein the electronic modulating device comprises a video camera.

5. The electronic system of claim 1 wherein the flat panel display comprises a plasma display.

6. The electronic system of claim 1 wherein the flat panel display comprises a liquid crystal display.

7. The electronic system of claim 6 wherein the liquid crystal display comprises an active matrix liquid crystal display.

8. The electronic system of claim 1 wherein the rail and frame members are integrally formed with one another.

9. The electronic system of claim 1 wherein the unitary spacing structure comprises a porous material.

10. The electronic system of claim 1 wherein at least some of the rail members have a notch disposed therein that interconnects with a corresponding notch in at least one other rail member.

11. The electronic system of claim 1 wherein the unitary spacing structure is attached to at least one of either the base panel or the face panel.

12. An electronic system for displaying an image, the electronic system comprising:

an electronic modulating device that transmits control signals; and a display operatively coupled to the electronic modulating device that receives the control signals from the electronic modulating device, the display comprising:

a base panel having a surface with generally planar areas;

a substantially transparent face panel having a surface with generally planar areas facing the surface of the base panel and having an opposing viewing surface for displaying an image thereon;

a unitary spacing structure including a plurality of interconnecting elongated members of uniform height interposed between the face panel and the base panel and projecting therebetween to maintain the face panel in a substantially parallel spaced-apart relationship with the base panel, the elongated members extending along directions that are substantially parallel with the surfaces of the base and face panels; and an image generator connected to the face and base panels and positioned to the image on the viewing surface.

13. The electronic system of claim 12 wherein the electronic modulating device comprises a computer system including an input device, a memory, and a processor coupled to the input device and the memory and providing the control signals to the flat panel display.

14. The electronic system of claim 12 wherein the electronic modulating device comprises a television.

15. The electronic system of claim 12 wherein the electronic modulating device comprises a video camera.

16. The electronic system of claim 12 wherein the flat panel display comprises a plasma display.

17. The electronic system of claim 12 wherein the flat panel display comprises a liquid crystal display.

18. The electronic system of claim 12 wherein the rail and frame members are integrally formed with one another.

19. The electronic system of claim 12 wherein the unitary spacing structure comprises a porous material.

20. The electronic system of claim 12 wherein at least some of the rail members have a notch disposed therein that interconnects with a corresponding notch in at least one other rail member.

21. The electronic system of claim 12 wherein the unitary spacing structure is attached to at least one of either the base panel or the face panel.

* * * * *